US005609933A

United States Patent [19]

Stepanek

[11] Patent Number: 5,609,933

[45] **Date of Patent: *Mar. 11, 1997**

[54] ADHERING CEREMONIAL ROLL

[75] Inventor: Michael J. Stepanek, Hollis, N.H.

[73] Assignee: Hampshire Paper Corp., Milford, N.H.

[ * ] Notice: The term of this patent shall not extend beyond the expiration date of Pat. No. 5,449,539.

[21] Appl. No.: 508,049

[22] Filed: Jul. 27, 1995

Related U.S. Application Data

[63] Continuation-in-part of Ser. No. 410,091, Mar. 23, 1995, and Ser. No. 369,650, Jan. 6, 1995, Pat. No. 5,449,539, which is a continuation-in-part of Ser. No. 144,333, Nov. 1, 1993, Pat. No. 5,401,548, which is a continuation-in-part of Ser. No. 954,027, Sep. 30, 1992, abandoned, said Ser. No. 410,091, is a division of Ser. No. 144,333, Nov. 1, 1993, Pat. No. 5,401,548, which is a continuation-in-part of Ser. No. 954,027, Sep. 30, 1992, abandoned.

[51] Int. Cl.[6] ..... D04D 9/00

[52] U.S. Cl. ..... 428/40.1; 52/273; 150/154; 108/90; 428/41.3; 428/41.7; 428/41.8; 428/42.1; 428/194; 428/214; 428/215; 428/220; 428/906; 442/416

[58] Field of Search ..... 428/40.1, 41.3, 428/41.7, 41.8, 42.1, 194, 220, 214, 215, 224, 906; 108/90; 206/389, 411; 150/154; 52/273; 118/505

[56] References Cited

U.S. PATENT DOCUMENTS

| | | | |
|---|---|---|---|
| 3,752,304 | 8/1973 | Alef | 428/43 |
| 4,988,550 | 1/1991 | Keyser | 428/43 |
| 5,401,548 | 3/1995 | Stepanek | 428/40.1 |
| 5,449,539 | 9/1995 | Stepanek | 428/42.1 |

*Primary Examiner*—Nasser Ahmad
*Attorney, Agent, or Firm*—Stephen W. White

[57] ABSTRACT

A ceremonial roll of material that can be easily unrolled and used is described. The roll contains a small layer or strip of releasable adhesive located on the floor surface of the roll within a starting end region of the roll. This adhesive is then pressed onto the floor itself before the roll is rolled down the aisle or walkway to be used. The adhesive will hold to the floor during the unrolling but can easily be removed by pulling up at an angle from the floor. The ceremonial roll may be made from a host of materials but a non-woven material made from long, natural and synthetic fibers and wherein the non-woven material is made from materials made from component fibers or other particles from polyesters, polypropylenes, polyamides, nylons, rayons, pulps, hemps, cottons, polyolefins and mixtures of two or more of these materials, is preferred. The ceremonial roll may also contain a plurality of adhesive strips within the starting end region to permit the roll to be placed over a set of stairs or steps.

6 Claims, 2 Drawing Sheets

ADHERING CEREMONIAL ROLL

BACKGROUND OF THE INVENTION

This invention is a continuation-in-part application of U.S. Ser. No. 08/410,091, filed on Mar. 23, 1995 pending which is a divisional application of U.S. Ser. No. 08/144,333, filed on Nov. 1, 1993, now U.S. Pat. No. 5,401,548, incorporated herein by reference, and which is a continuation-in-part application of U.S. Ser. No. 07/954,027, filed on Sep. 30, 1992, now abandoned. This application is also a continuation-in-part application of U.S. Ser. No. 08/369,650, filed on Jan. 6, 1995, now U.S. Pat. No. 5,449,539 , and incorporated herein by reference, which is a continuation-in-part application of U.S. Ser. No. 08/144,333, filed on Nov. 1, 1993, now U.S. Pat. No. 5,401,548, which is a continuation-in-part of U.S. Ser. No. 07/954,027, filed on Sep. 30, 1992, now abandoned.

1. Field of the Invention

This invention relates to ceremonial rolls of material, e.g. non-woven fabric, plastic and the like. Specifically, this invention relates to ceremonial rolls of material used to line an aisle or walkway. Even more specifically, this invention relates to ceremonial rolls of material that can be conveniently laid on said aisle or said walkway and which contain a removable tape or line of adhesive to permit easy setting and removing of said roll from said aisle or said walkway. Still more specifically, this invention relates to ceremonial rolls that can be used on a plurality of walkways including those containing stairs and the like.

2. Description of the Prior Art

The concept of using some sort of runner to put down in an aisle or walkway just before a ceremonial event, is well-known in the prior art. Such runners are used when dignitaries arrive for some sort of function. More specifically, such runners are commonly used during the wedding ceremony and are placed in the aisle of a church, synagogue or some other place where a wedding is about to take place. The dignitary or bride and the parties associated therewith then walk down on the runner. Sometimes, these runners are made of cloth or other fabric and sometimes they are made from plastic and the like. These materials must be strong enough to resist damage due to walking and yet light enough to allow quick and easy use. The most common runner used in the prior art is made from a so-called non-woven material. The materials of construction for these non-woven elements may be taken from a group comprising polyesters, polypropylenes, polyamides, nylons, rayons, hemps and pulps, cotton and polyolefins or mixtures of two or more of these components.

These ceremonial events usually require that the roll be laid down just prior to use and assistants present usually place one end of the roll at the point where the users will finish their walk and then roll the remainder down the aisle or walkway. When a roll of non-woven material is used, it is conventional for the assistants to have the roll on a rope so that it can be unrolled very easily. During weddings, for example, the ushers, attendants or others from the wedding party have a roll of white non-woven material or plastic. In the center, core of the roll, a decorative rope is conventionally threaded. The attendants place the start of the roll at the point where the bride will finish her walk down the aisle to that point where the wedding ceremonial march begins. Using the rope, they pull this roll down this aisle or walkway to cover the walking surface with the material contained on the roll. The bride then enters and walks on the covered aisle to participate in the wedding ceremony. All of this adds beauty, pomp and circumstance to this ceremony. Many of these rolls of material are embossed, printed or otherwise decorated to add beauty to the surface thereof. Sometimes these rolls are unrolled right along the floor and sometimes they are held just above the floor at an angle thereto just prior to being unrolled.

There are, however, problems with the un-rolling of this ceremonial walkway cover. Since the material is light, there is a tendency that it will not lie properly on the floor of the walkway. Usually, one of the attendants is forced to stand on the beginning of the roll to insure that it does not trail after those who are unrolling same. If there is a slight breeze that occurs when a door opens, for example, there is also a tendency for this unrolled material to be ruffled up by this breeze to become wrinkled and unsightly. Usually, there is a scramble by the attendants to insure that this walkway remains covered in a neat and straight manner by the ceremonial roll of material. This scrambling detracts from the main reason for this ceremony and presents serious problems.

In yet another ceremonial event, the walkway may contain floors of varying composition (e.g. carpet, wood, cementitious materials, synthetics, etc.) and may also contain a set of stairs, for example, and thus the placement of the ceremonial roll becomes even more difficult. The roll may not lie securely on the steps or may tend to curl excessively over varying floor compositions.

The use of adhesives and the like to attach materials to floors and the like are well-known. The use of double-side coated tapes to hold down carpets is an example of this use. Most of these adhesives tend to stick permanently or at least semi-permanently to the floor in order to hold the carpet in a firm position over a long period of time. When these materials are removed, much of the adhesive remains on the floor and must be removed by the use of solvents or by scraping.

The use of temporary adhesives for various and sundry purposes is also well-known. Most of these uses involve decorative ribbons for packaging; temporary material for posting notes and the like; sheets of drafting paper; among many others. These temporary adhesives are of the tack/release type well-known in the prior art. They are designed to provide a temporary tackiness to the material on which they are applied. Most of these tack materials will not withstand a hard pull during use.

There is a long-standing need to provide a ceremonial roll of material with some sort of glue or adhesive that will hold the roll in place during unrolling and during use and yet which can be easily removed from the floor surface without damage either to the floor or to the roll itself.

SUMMARY OF THE INVENTION

It is an object of this invention to provide a ceremonial roll of material used to cover a walkway or an aisle during such a ceremony. It is yet another object of this invention to provide this ceremonial roll with sufficient tack-release adhesive to allow for adequate adhesion during use but which can be easily removed after such use. Yet another object is to provide a ceremonial roll containing tack-release adhesive materials over a broad range of the roll in order to enhance some specific utility. Finally, it is a specific object of this invention to provide a non-woven material roll used to cover the aisle during a wedding wherein said roll contains sufficient adhesive proximate or within the starting end region of the roll to permit the unrolling of the roll and to withstand such force as is required therefor. These and yet other objects are achieved in a ceremonial covering for a walkway comprising a ceremonial material having a length and width dimensioned for the walkway, a walking surface adapted to a ceremony, and a floor surface opposite the walking surface and a pressure sensitive adhesive attached to the floor surface at a starting end region of the material, wherein said starting end region is defined as that portion of the length of the roll starting from 2 inches and including up to 20 percent of the length of said roll.

In yet another embodiment, said roll may contain a plurality of strips of pressure sensitive adhesive located at varying locations along the starting end region of said roll. Additionally, the ceremonial material may be non-woven.

By non-woven material 1 mean material that is taken from the component group of materials consisting of polyesters, polypropylenes, polyamides, nylons, rayons, pulp, hemp, cotton and polyesters and mixtures of two or more of these components.

The starting end region of the roll, which includes the pressure sensitive adhesive layer or layers, is applied to the floor surface of the walkway in such a manner that the roll is unrolled at an angle of less than 30° and preferably between 0° and 30° from said walk way, the adhesive will withstand a pull of less than 300 pounds of pull and preferably between 10 to 300 pounds of pull without being removed from said roll or said walk way. The pressure sensitive adhesive is usually of the releasable, double-sided type and must be specifically designed and applied to the ceremonial roll to meet these specifications.

In yet another embodiment this invention relates to a process for applying a pressure sensitive adhesive to a ceremonial roll of material comprising the steps of applying said adhesive to said roll of material at an operating temperature of from 120° to 175° F. and a pressure of 35° to 80 psi for 5 to 10 seconds.

DETAILS OF THE INVENTION

Figure 1:
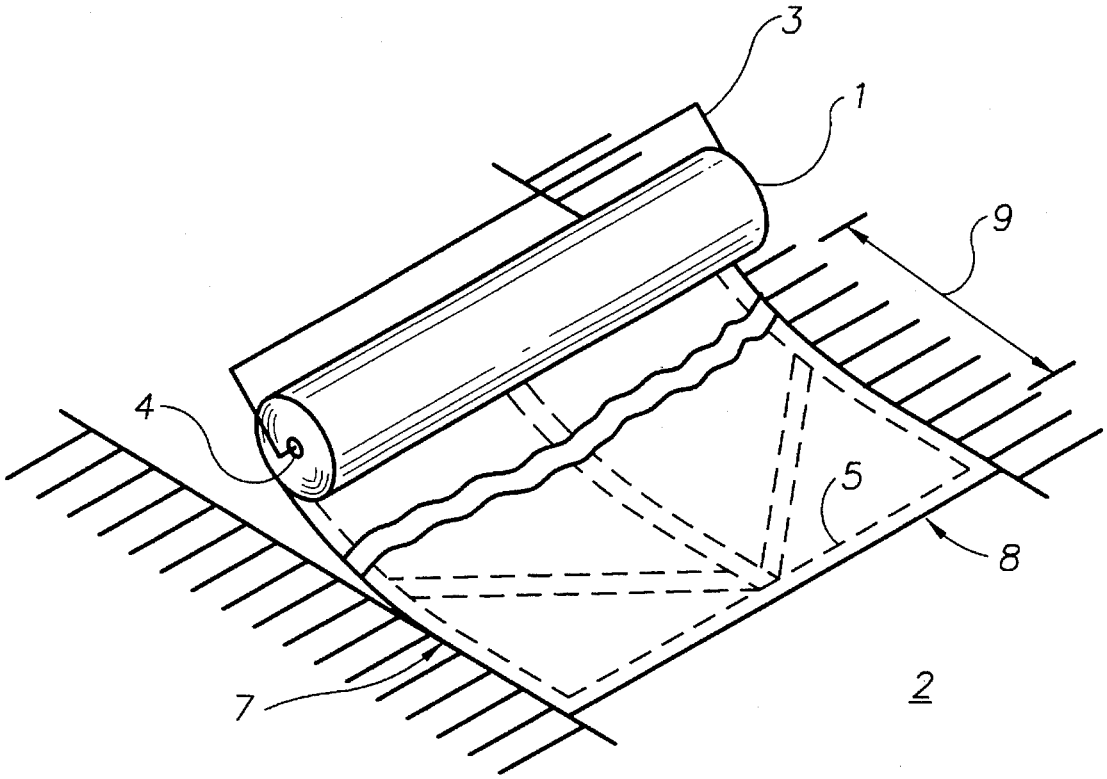
FIG. 1 is a showing of a typical ceremonial roll of material being unrolled down an aisle or walkway.

Ceremonial rolls of material used to cover aisles and walkways prior to the onset of the desired ceremony are legion in number. Most of these are prepared from a non-woven material (e.g. non-woven fabrics, plastic sheeting and the like). These materials can be manufactured in a myriad of colors and can be decoratively embossed and/or printed. In most cases, these rolls are discarded after use, especially if particularly soiled. There are a number of other materials used to make such ceremonial rolls including very thin polymeric plastics such as polyethylene, for example. Additionally, these rolls may be made entirely of non-woven cloth or fabric. By non-woven materials I mean a fabric-like material made by combining long, natural and synthetic fibers for strength, light weight and controlled porosity by unique and proprietary bonding methods, chemical treatments and softening processes which also add to the strength and softness quality of this material. Within the metes and bounds of this invention, when I refer to "non-woven material" I mean those materials made from component fibers or other particles from polyesters, polypropylenes, polyamides, nylons, rayons, pulps, hemps, cottons and polyolefins and mixtures of two or more of these components. The presence of synthetic and natural fibers vs. cellulosic fibers in this material is what differentiates non-woven material from paper. A particularly preferred non-woven material is manufactured by Irving Textiles Company, Atglenn, Pa. Other manufacturers include Johnson & Johnson Co.; Scott Paper Co., Non-Woven Division; Proctor & Gamble Co.; Dexter Co., Non-Woven Division; and International Paper Co.

During use, the roll of material is typically unrolled using a handle down the aisle or walkway over which the bride or dignitary will walk. Since these materials are often flimsy, they tend to unroll with difficulty and will not stay in the desired location. It is common for members of the wedding party or other attendants to try and hold the roll down whilst it is being unrolled. This is not a desired action as many attendants or assistants are required for this step. This invention solves many of these problems by providing a small layer of removable adhesive to the floor surface of the ceremonial roll at the starting end region thereof.

The starting end region of the ceremonial roll is, for purposes of the present Application, defined as a region extending from about 2 inches from the very starting end of the ceremonial roll a distance which is up to twenty percent of the length of the ceremonial roll. Thus, if the ceremonial roll is one hundred feet in length, the starting end region is defined as the first twenty feet (less 2 inches) of the ceremonial roll as measured from the starting end. In this example, the removable adhesive which is applied to the floor surface of the ceremonial roll is located within the starting end region (first twenty feet, less 2 inches) of the ceremonial region roll. The removable adhesive may be applied across the starting end region of the ceremonial roll, parallel to the starting end of the roll; perpendicular to the starting end of the roll and parallel to the side or edges of the ceremonial roll; diagonally, across the floor surface of the ceremonial roll within the starting end region of the roll; or any and all combinations thereof. The purpose of the adhesive layer is to maintain the starting region of the ceremonial roll in contact with a walkway and thus, allowing the individuals unrolling the ceremonial roll to do so without concern about whether the starting end region of the ceremonial roll will move from the surface of the walkway.

The layer of removable adhesive may be applied on the sides of the walking surface of the roll or down the middle of the walking surface or some other useful location within the starting end region to insure that the roll stays down during unrolling. The attendants or assistants simply press this layer on the floor and then can conveniently and easily unroll the roll down the aisle or walkway. The adhesive, however, must hold the roll firmly to the floor during the unrolling step but must be easily removed after the ceremony so that the floor does not become damaged by the presence of excess adhesive. Additionally, the adhesive must resist the force of pull on the ceremonial roll without being dislodged from said roll. Since there are many different types of floors finding the correct adhesive for each type of floor is a time consuming process. What I have found in this invention that if the adhesive is applied to the ceremonial roll by a particular method or process, both steps outlined above will be solved. The adhesive will adhere strongly to the roll during application and will also adhere to any floor surface during application yet can be easily removed later.

A normal walk way, such as an aisle or passage way will be from about 20 inches to about 55 inches in width, with 20 inches to about 40 inches being normal, average walk way width. We prefer that the ceremonial rolls of this invention fit within the metes and bounds of the normal walk way and thus the roll width can be within these specifications. A most preferred walk way width and ceremonial roll width is 36 inches.

In yet another embodiment, the walkway may contain a set of stairs or steps, for example. In this particular instance, it may be necessary to apply a plurality of strips of pressure sensitive adhesives within varying positions of the floor surface of the ceremonial roll. This will then permit the roll to be held firmly over the steps.

The ceremonial rolls of this invention may be undecorated or decorated, e.g. embossed with a pattern or having a printed pattern thereon. A particularly preferred ceremonial roll will have decorative pattern embossed on the surface thereof, with the decorative pattern matching the ceremony involved.

Referring now specifically to the drawings, FIG. 1 shows a typical ceremonial roll of material 1 being laid on an aisle or walkway 2. The roll is being pulled by a rope 3 (or handle) which is strung through a core 4. A typical adhesive has been applied to the floor surface of the roll and this is shown by dotted lines 5.

One end of the ceremonial roll 1 includes a starting end region 7 having a length shown generally by arrow 9 and extending from the starting end of the roll (less 2 inches) 8 a distance of up to twenty percent of the overall length (less 2 inches) of the ceremonial roll 1. Thus, if the ceremonial roll is one hundred feet in overall length, the starting end region 7 can extend up to and including twenty feet from the starting end 8 (less 2 inches) of the ceremonial roll 1. If the ceremonial roll 1 is fifty feet in overall length, the starting end region 7 may extend up to and including a distance of ten feet (less 2 inches) from the starting end 8 of ceremonial roll 1. Other starting end region lengths can be easily computed based on the overall length of the ceremonial roll 1.

Thus, the adhesive layer extends from the starting end of the floor abutting surface of the roll (less 2 inches) a distance substantially less than the length of the roll, substantially less being within the first twenty percent of the length of the roll previously defined as the starting end region of the ceremonial roll. In one embodiment, the adhesive layer extends from the starting end of the roll (less 2 inches). In other embodiments, the adhesive layer need not start from the starting end of the ceremonial roll by rather, may be disposed anywhere within the starting end region of the ceremonial roll.

Figure 2:
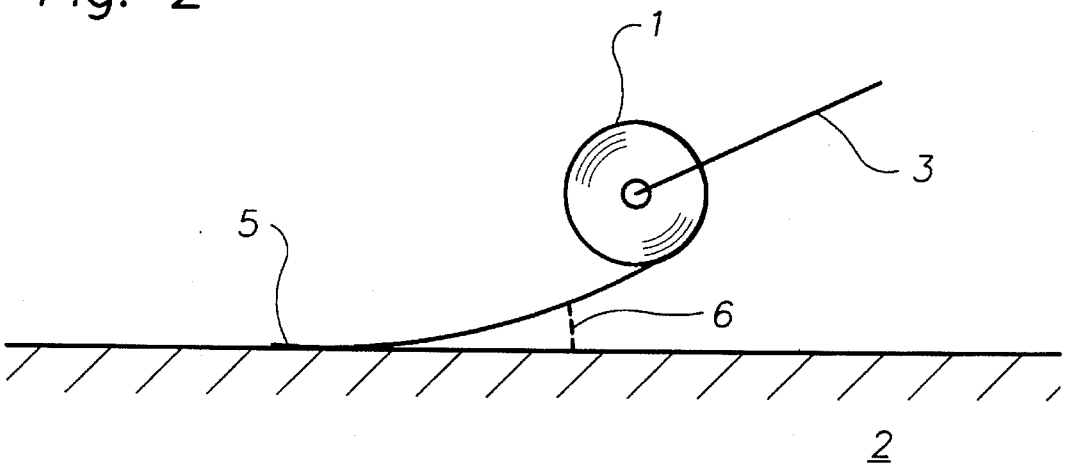
FIG. 2 is a side view showing of the roll of FIG. 1 demonstrating the angles at which said roll of material can be unrolled to cover said aisle or walkway.

FIG. 2 is a side view of the roll 1. In this showing, the rope or handle 3 is pulling roll 1 at an angle 6. This angle can be varied from 0° to 30° without affecting release of the glue at 5.

Figure 3:
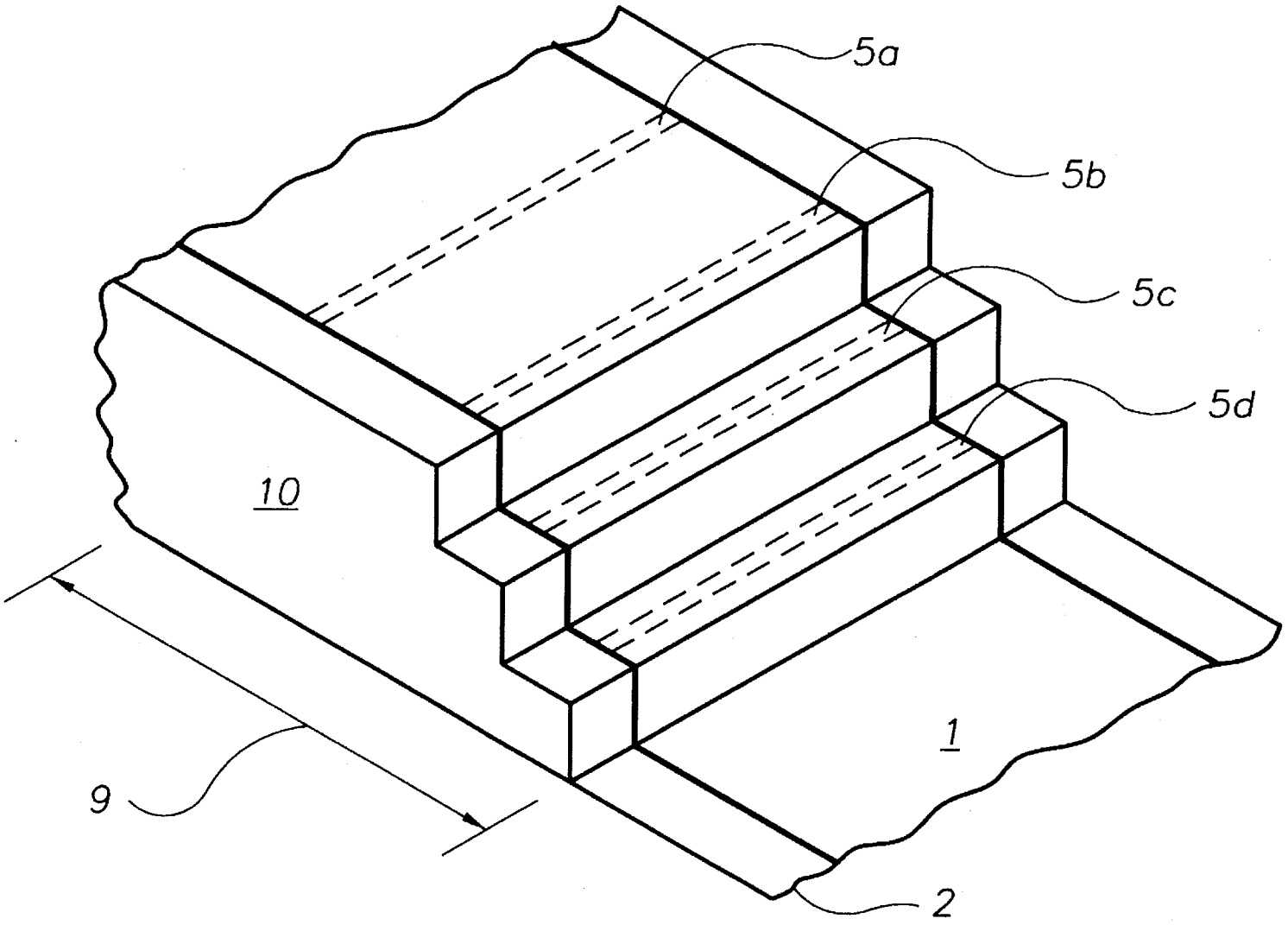
FIG. 3 is a view showing a typical ceremonial roll laid over a walkway and up a set of steps or stairs.

FIG. 3 is a view of an aisle or walkway 2 which additionally contains a set of steps or stairs 10. The ceremonial roll 1 has been laid down over this particular aisle or walkway embodiment and varying strips of adhesive *5a, 5b, 5c,* and *5d* have been applied over the starting end region 9 in order to hold the ceremonial roll down.

A number of different types of adhesives can be used within the metes and bounds of this invention. These adhesives include, among others, the following:

| Composition | Manufacturer |
|---|---|
| Acrylic Paper Tape | Permacel ® #5033X Double Coated Tape, 3M Corp., Minneapolis, MN. |
| Acrylic Tape | #465, 3M Corp., Minneapolis, MN. |
| Double Coated Tape | $410, 3M Corp., Minneapolis, MN. |
| Acrylic Adhesive | (Economy Grade tesa 7003, tti tesa tuck Inc., Sparta, Splicing Tape) Sparta, MI. |
| Acrylic Adhesive | (Corrugator Splicing Tape) tesa 7158, tti tesa tuck Inc., Sparta, MI. |
| Acrylic Adhesive | (Premium Grade Splicing Tape) tesa 4900, tti tesa tuck, Inc., Sparta, MI. |
| Acrylic Adhesive | (Light Duty Ass. Tape) tesa 4900 PV9, tti tesa tuck, Inc., Sparta, MI. |
| Rubber Resin | (General Purpose Mounting & Joining Tape) tesa 4903, tti tesa tuck, Inc., Sparta, MI. |
| Acrylic Adhesive | (General Purpose Affixing, Joining & Splicing Tape) tesa 4959, tti tesa tuck, Inc., Sparta, MI. |

Although many glues are known in the prior art and many have been described as releasable, the process of application of the glue on the floor surface of the ceremonial roll of material is very important. It is this process which provides the requisite adherence to the roll and any of the conventional floor surfaces during use yet permits the removal of the glued roll after use. This removal can easily be accomplished by pulling the roll at a force of more than 300 pounds of pull at an angle of greater than 30° from the floor surface. Sometimes, when the ceremonial roll is semi-transparent, for example, it is required that the adhesive layer itself be transparent so as not to be observable during the ceremony. This can be accomplished by applying the adhesive layer in a thin but wide strip across the end of the roll on the floor surface thereof. If, however, the roll is not transparent in nature, a thicker and narrower strip of adhesive can be applied or at one or more desired locations within the starting end region of the ceremonial roll to function in the same manner. I prefer that the ceremonial roll be a non-woven material containing cloth, pulp, hemp or fabric fibers therein and that the adhesive be applied as a ¼ to 6 inch wide strip and preferably as a ½ inch to 2 inch wide strip (1.0 inch particularly preferred). The adhesive can be applied at a coating thickness of between 0.5 to 8 mils and preferably 1 to 6 mils (prefer 4 mils).

In a specific application and process of this invention, the release-type adhesive is applied to a non-woven material runner as a tape or strip of the adhesive. This application involves imbedding the adhesive into the floor surface of the material at the starting end by heating and laminating the adhesive under pressure. The adhesive material is applied at a pressure of between 35 to 80 psi and at a temperature of between 120° to 175° F. The time for this process is between 3 to 15 seconds. I prefer to apply the adhesive at 75 psi, 150° F. for 5 to 10 seconds. A strip of releasable paper may then be applied over the adhesive so that the non-woven material can be rolled without interference from the adhesive layer, in fact it is so preferred.

When the roll is to be used in a ceremony, for example, the releasable paper is simply stripped off, the end of the roll containing the adhesive layer is then placed down firmly on the floor surface and the roll is un-rolled. This adhesive layer, applied as described herein and used in this manner, will hold this end of the roll in place while the roll is being un-rolled without being stripped from the material itself. Additionally, this end of the roll can be easily stripped from any conventional flooring without leaving traces of glue thereon. This is extremely important since many areas where ceremonial functions are held have expensive flooring in place. This is particularly true in churches, synagogues and the like. The application of a non-removable glue left on the decorative floors of these institutions would be highly undesirable.

In un-rolling the ceremonial roll, it is conventional to pull the roll down the aisle or walkway just prior to the entry of the celebrants or dignitaries. This can be accomplished in a number of ways. During weddings and the like, the roll is carried by a decorative rope or handle which is threaded through the core of the roll. The handle may additionally contain a small piece of wood or the like to assist the user or users further. The roll may be simply dragged along the floor at an angle of 0° or it may be lifted up somewhat to accomplish the same effect. In any case, the glue should not be detached from the floor even if the roll is lifted to a 30° angle from the floor during this step. When the ceremony or service is over, the ceremonial roll can be easily stripped from the floor by lifting the end attached to the floor by the adhesive at an angle greater than 30°. For example, grasping the roll near the adhesive end and pulling straight up at 90° and a force greater than 300 pounds will effect complete release from the floor without stripping the glue from the roll itself.

Those skilled in the art will know, or be able to ascertain, using no more than routine experimentation, many equivalents to the specific embodiments of the invention described herein. These and all other equivalents are intended to be encompassed by the following claims:

What is claimed is:

1. A ceremonial covering for a walkway comprising a continuous ceremonial roll of non-woven material, excluding paper, said material comprising fabric material made by combining long, natural and synthetic fibers, said fibers taking from the group of materials consisting of polyesters, polypropylenes, polyamides, nylons, rayons, pulps, hemps, cottons, polyolefins and mixtures of two or more of these materials, said roll having a width and including a starting end, a starting end region, a walking surface adapted to a ceremony and a floor abutting surface;

at least a portion of said width of said floor abutting surface at said starting end region including a releasable, double-sided, pressure sensitive adhesive layer, said starting end region being defined as that portion of the length of the roll starting from two inches from said starting end and including up to 20 percent of the length of said roll;

wherein a first side of said releasable, double-sided, pressure sensitive adhesive layer is applied to said floor abutting Surface of said roll, and wherein a second side of said double-sided, pressure sensitive adhesive layer is covered by a releasable strip of material, thus forming a ceremonial covering for a walkway with a pressure sensitive adhesive layer at said starting end of said roll, for allowing said second side of said double-sided, pressure sensitive adhesive layer to be applied to said walkway, for releasably maintaining said starting end region of said roll in contact with said walkway, and for allowing said starting end region of said roll to be removed from contact with said walkway by positioning said starting end region of said roll at an angle relative to said walkway, and by applying a force to said roll.

2. The ceremonial covering of claim 1 wherein said pressure sensitive adhesive is applied within said starting end region of said roll and parallel to said starting end of said roll.

3. The ceremonial roll of claim 1 wherein the width of said roll is defined by parallel edges and said pressure sensitive adhesive is applied within said starting end region of said roll parallel to said edges of said ceremonial roll.

4. The ceremonial roll of claim 1 wherein said pressure sensitive adhesive is applied diagonally relative to said starting end of said roll.

5. The ceremonial roll of claim 1 wherein said material is decoratively embossed.

6. The ceremonial roll of claim 1 wherein said walkway contains stairs and said double-sided, pressure sensitive adhesive layer is applied in a plurality of locations within said starting end region of said roll.

* * * * *